US009844243B2

(12) United States Patent
Langvin et al.

(10) Patent No.: US 9,844,243 B2
(45) Date of Patent: Dec. 19, 2017

(54) PROTECTIVE COVER AND GRAPHIC TRANSFER ASSEMBLY

(71) Applicant: Nike, Inc., Beaverton, OR (US)

(72) Inventors: Elizabeth Langvin, Sherwood, OR (US); David P. Jones, Beaverton, OR (US); Jeremy L. Connell, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 733 days.

(21) Appl. No.: 13/746,415

(22) Filed: Jan. 22, 2013

(65) Prior Publication Data

US 2014/0033580 A1 Feb. 6, 2014

Related U.S. Application Data

(60) Continuation-in-part of application No. 13/622,552, filed on Sep. 19, 2012, now Pat. No. 8,851,135, which is a continuation of application No. 13/352,717, filed on Jan. 18, 2012, now Pat. No. 8,293,054, which is a division of application No. 12/245,402, filed on Oct. 3, 2008, now Pat. No. 8,162,022.

(51) Int. Cl.

| | |
|---|---|
| ***A43B 23/00*** | (2006.01) |
| ***A43D 95/14*** | (2006.01) |
| ***B44C 1/10*** | (2006.01) |
| ***B44C 1/17*** | (2006.01) |

(52) U.S. Cl.

CPC ..... *A43B 23/00* (2013.01); *A43D 95/14* (2013.01); *B44C 1/105* (2013.01); *B44C 1/17* (2013.01); *B44C 1/1712* (2013.01)

(58) Field of Classification Search

CPC ..... A43B 23/0205; A43B 23/0275; A43B 23/0295; A43B 1/00; A43B 3/00

USPC ..... 36/132, 136, 7.1; 2/425

See application file for complete search history.

(56) References Cited

U.S. PATENT DOCUMENTS

| | | | |
|---|---|---|---|
| 1,893,795 | A | 1/1933 | Chapman |
| 1,970,600 | A | 8/1934 | Frost |
| 2,182,022 | A | 12/1939 | Griswold |
| 2,466,598 | A | 4/1949 | La Civita |
| 2,537,785 | A | 1/1951 | Oppenheim |

(Continued)

FOREIGN PATENT DOCUMENTS

| | | |
|---|---|---|
| CN | 1179131 | 4/1998 |
| CN | 102239056 | 11/2011 |

(Continued)

OTHER PUBLICATIONS

Chinese Office Action dated Sep. 18, 2014 in Chinese Patent Application No. 200980148611.8.

(Continued)

*Primary Examiner* — Jila M Mohandesi
(74) *Attorney, Agent, or Firm* — Banner & Witcoff, Ltd.

(57) ABSTRACT

A protective member for a graphic transfer assembly includes an interior portion to receive a sole structure of an article of footwear. The protective member may protect the sole structure from heat applied by a graphic transfer assembly. The protective member can also prevent portions of a sole structure from damaging components of a graphic transfer assembly. The protective member can be contoured to improve the seal between deformable membranes of the graphic transfer assembly.

15 Claims, 12 Drawing Sheets

(56) References Cited

U.S. PATENT DOCUMENTS 2,647,337 A 8/1953 Martin
2,651,119 A 9/1953 Harrington
2,651,857 A 9/1953 Griswold et al.
3,362,091 A 1/1968 Drago
3,483,580 A 12/1969 Cherry et al.
3,803,655 A 4/1974 White et al.
4,078,962 A 3/1978 Krueger
4,101,983 A * 7/1978 Dera ..... A42B 3/0413 2/412
4,183,157 A * 1/1980 Counselman ..... A43B 5/185 36/135
4,188,254 A 2/1980 Hemperly, Jr.
4,247,355 A 1/1981 Friedrick et al.
4,265,033 A * 5/1981 Pols ..... A43B 7/00 36/110
4,266,312 A 5/1981 Hall
4,326,345 A * 4/1982 Sbicca ..... A43B 13/04 36/135
4,505,975 A 3/1985 Majima
4,660,242 A 4/1987 Vornberger et al.
4,670,084 A 6/1987 Durand
4,704,810 A * 11/1987 Massengale ..... A43B 5/18 36/130
4,724,026 A 2/1988 Nelson
4,792,376 A 12/1988 Denley
4,888,713 A 12/1989 Falk
4,899,411 A 2/1990 Johnson et al.
4,964,229 A 10/1990 Laberge
5,046,193 A * 9/1991 Foresman ..... A42B 1/12 2/195.7
5,087,495 A 2/1992 Nelson
5,097,390 A 3/1992 Gerrie et al.
5,231,703 A * 8/1993 Garneau ..... A42B 3/066 2/414
5,255,352 A 10/1993 Falk
5,272,773 A * 12/1993 Kamata ..... A42B 3/066 2/421
5,296,182 A 3/1994 Thary
5,337,421 A * 8/1994 Jeng ..... A42B 3/28 2/171.3
5,341,532 A 8/1994 Markowitz
5,414,975 A 5/1995 Hummel
5,464,337 A 11/1995 Bernardon et al.
5,477,577 A 12/1995 Hadley
5,486,397 A 1/1996 Gordon et al.
5,511,608 A 4/1996 Boyd
5,619,756 A * 4/1997 Garneau ..... A42B 3/066 2/411
5,885,500 A 3/1999 Tawney et al.
5,893,964 A 4/1999 Claveau
5,896,587 A * 4/1999 Gentry ..... A42B 3/061 2/12
D413,711 S * 9/1999 Hicks, Jr. ..... D2/909
5,953,762 A * 9/1999 Corbett ..... A42B 3/0406 2/422
5,962,368 A 10/1999 Poole
5,985,416 A 11/1999 Sherman et al.
5,994,264 A 11/1999 Sherman et al.
6,237,174 B1 * 5/2001 Hutchinson ..... A43B 3/101 12/142 G
6,295,679 B1 10/2001 Chenevert
6,299,817 B1 10/2001 Parkinson
6,485,668 B1 11/2002 Murphy et al.
6,544,634 B1 4/2003 Abrams et al.
6,670,029 B2 12/2003 Norton et al.
6,718,880 B2 4/2004 Oshima et al.
6,833,171 B2 * 12/2004 Campbell ..... A43B 3/16 36/4
6,855,171 B2 2/2005 Morlacchi
6,971,135 B2 12/2005 Nadler
6,984,281 B2 1/2006 Oshima et al.
6,994,765 B2 2/2006 Oshima et al.
7,013,580 B2 3/2006 Morlacchi
7,166,249 B2 1/2007 Abrams et al.
7,563,341 B2 7/2009 Ferguson et al.
7,779,560 B2 * 8/2010 Kay ..... A43B 3/26 36/135
D636,977 S * 5/2011 Yarn ..... D2/909
7,950,432 B2 5/2011 Langvin et al.
8,162,022 B2 4/2012 Hull et al.
8,293,054 B2 10/2012 Hull et al.
8,453,355 B2 * 6/2013 Kay ..... A43B 5/185 36/135
D686,780 S * 7/2013 Rodgers ..... D29/122
2002/0023306 A1 2/2002 Sajedi et al.
2003/0046778 A1 3/2003 Sicurelli, Jr.
2003/0115679 A1 6/2003 Morlacchi et al.
2006/0005328 A1 1/2006 Johnson
2006/0024455 A1 2/2006 Oshima et al.
2006/0123567 A1 6/2006 Morlacchi
2007/0039682 A1 2/2007 Drake et al.
2007/0079928 A1 4/2007 Abrams et al.
2007/0130805 A1 6/2007 Brady et al.
2007/0151656 A1 7/2007 Gager et al.
2007/0185372 A1 8/2007 Anderson et al.
2008/0028544 A1 2/2008 Park
2008/0127426 A1 6/2008 Morlacchi et al.
2008/0141469 A1 6/2008 Park
2008/0250668 A1 10/2008 Marvin et al.
2009/0019648 A1 1/2009 Jones et al.
2010/0084083 A1 4/2010 Hull et al.
2010/0139853 A1 6/2010 Park
2010/0275393 A1 11/2010 Jou et al.
2010/0326591 A1 12/2010 Langvin et al.
2011/0088282 A1 4/2011 Dojan et al.
2012/0111487 A1 5/2012 Hull et al.
2013/0014900 A1 1/2013 Hull et al.

FOREIGN PATENT DOCUMENTS

CN 102239056 B 5/2016
EP 0264898 4/1988
EP 1000731 5/2000
EP 1635665 3/2006
FR 988355 8/1951
HK 1159029 7/2012
JP 9207149 8/1997
JP 2004105323 4/2004
JP 2012504511 2/2012
KR 20110093770 8/2011
KR 20130016393 2/2013
KR 20130018951 2/2013
WO 9003744 4/1990
WO 9008487 8/1990
WO 9629208 9/1996
WO 02072301 9/2002
WO 02094581 11/2002
WO 2004112525 12/2004
WO 2006095375 9/2006
WO 2007007369 1/2007
WO 2010039826 4/2010
WO 2011082275 7/2011

OTHER PUBLICATIONS

Chinese Office Action dated Aug. 26, 2015 in Chinese Patent Application No. 201310229340.7.
Invitation to Pay Additional Fees dated Jan. 28, 2010, with Annex containing results of International Search from PCT Application No. PCT/US2009/059018.
International Search Report dated Jul. 11, 2002 from PCT Application No. PCT/US2002/07617.
International Search Report and Written Opinion dated Apr. 20, 2010 in PCT Application No. PCT/US2009/059018.
International Preliminary Report on Patentability (including Written Opinion of the ISA) dated Apr. 14, 2011 in International Application No. PCT/US2009/059018.
International Search Report dated Oct. 4, 2011 in PCT Application No. PCT/US2010/039306.

(56) References Cited

OTHER PUBLICATIONS

International Preliminary Report on Patentability (including Written Opinion of the ISA) dated Jan. 12, 2012 in International Application No. PCT/US2010/039306.
Taiwanese Office Action dated Dec. 16, 2015 in Taiwanese Patent Application No. 99116338.
Notice of Allowance for Chinese Application No. 201310229336.0 dated Jun. 12, 2016, 4 pages.

* cited by examiner

PROTECTIVE COVER AND GRAPHIC TRANSFER ASSEMBLY

This application is a continuation-in-part of U.S. Pat. No. 8,851,135, now U.S. patent application Ser. No. 13/622,552, filed on Sep. 19, 2012, entitled "Method of Customizing an Article and Apparatus", which application is continuation of U.S. Pat. No. 8,293,054, now U.S. patent application Ser. No. 13/352,717, filed on Jan. 18, 2012 and issued on Oct. 23, 2012, entitled "Method of Customizing an Article and Apparatus", which application is a division of Hull et al., U.S. Pat. No. 8,162,022, now U.S. patent application Ser. No. 12/245,402, filed Oct. 3, 2008 and issued on Apr. 24, 2012, which is entitled "Method of Customizing an Article and Apparatus" (hereby referred to as the "Hull case"), all of which applications are hereby incorporated by reference in their entirety.

BACKGROUND

The present embodiments relate generally to articles of footwear, and in particular to protective covers for articles of footwear used with a graphic transfer assembly.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

SUMMARY

In one aspect, a protective member for an article of footwear includes a first side portion and a second side portion extending along a length of the protective member. The protective member includes a proximal portion where the first side portion and the second side portion are separated to form an opening for receiving a sole structure. The protective member includes a distal portion where the first side portion and the second side portion are joined along an edge. The protective member is configured to provide a barrier between the sole structure and at least one deformable membrane of a graphic transfer assembly.

In another aspect, a protective member for an article of footwear includes a first side portion and a second side portion extending along a length of the protective member. The protective member includes a proximal portion where the first side portion and the second side portion are separated by a first width. The proximal portion is configured to receive a sole structure. The protective member also includes a distal portion where the first side portion and the second side portion are separated by a second width. The first width is substantially greater than the second width. Also, the protective member is configured to provide a barrier between the sole structure and at least one deformable membrane of a graphic transfer assembly.

In another aspect, a protective member for an article of footwear includes a first side portion and a second side portion, where the first side portion and the second side portion are configured to cover a sole structure. The protective member also includes a clamping system. The clamping system is configured to attach the protective member to the sole structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
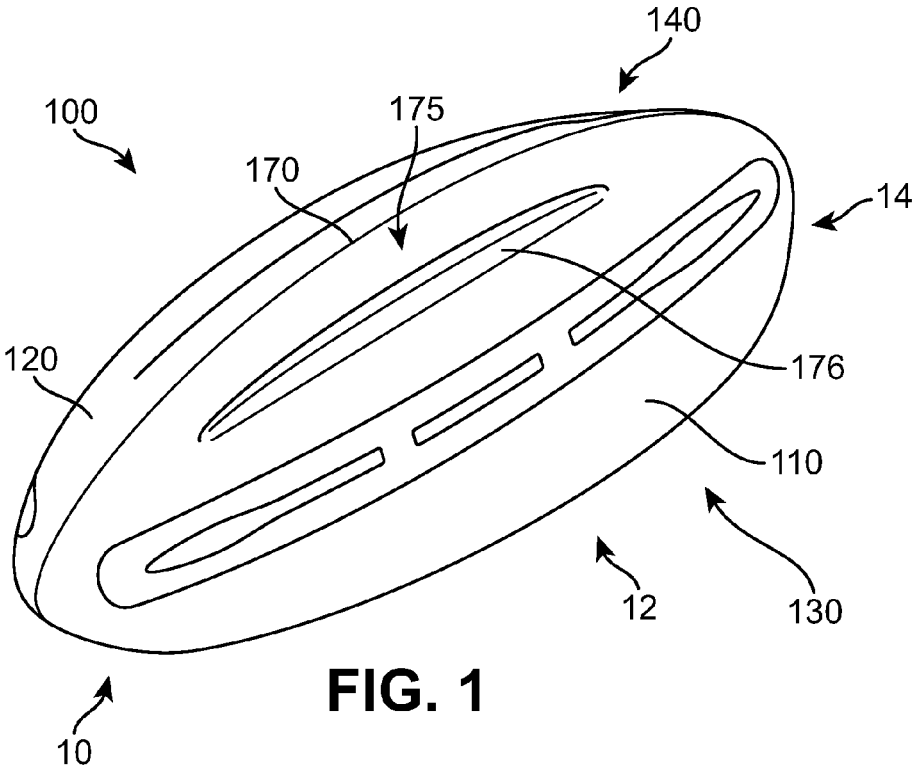
FIG. 1 is an isometric view of an embodiment of a protective member.
Figure 2:
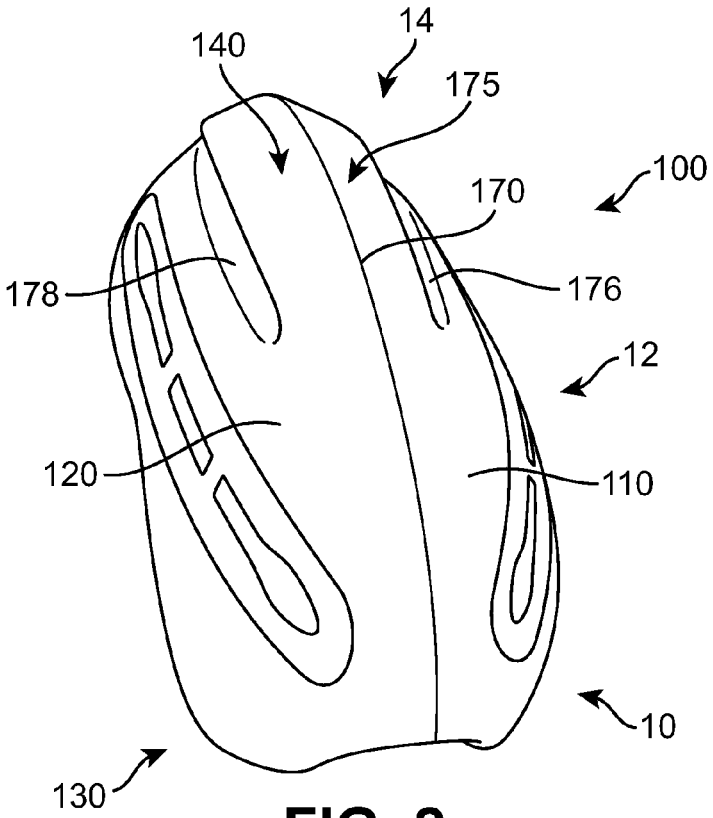
FIG. 2 is another isometric view of an embodiment of a protective member.
Figure 3:
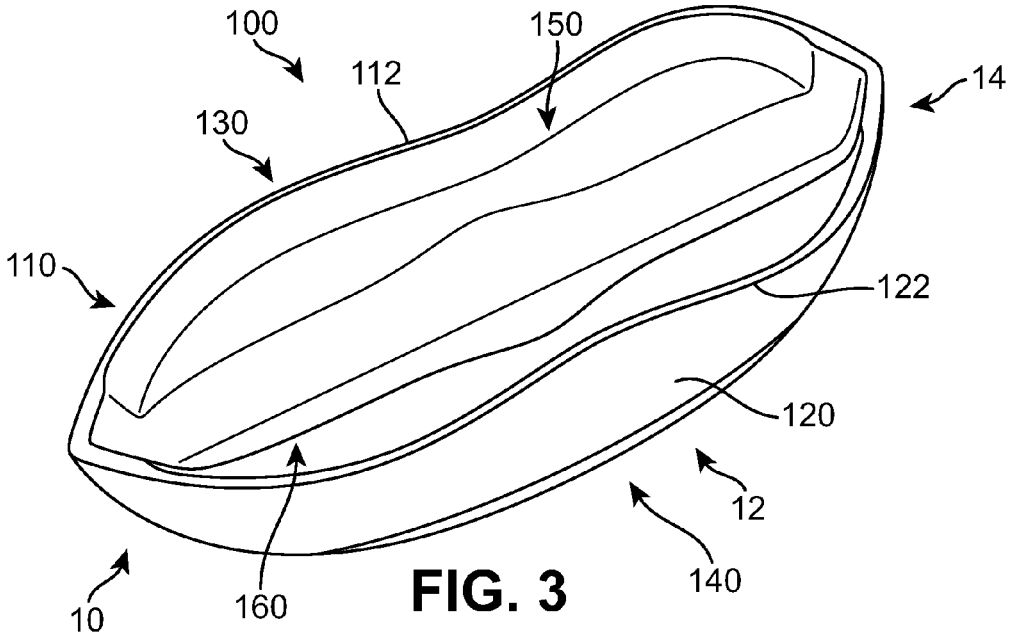
FIG. 3 is an isometric view of an embodiment of proximal portion of a protective member.

FIGS. 1 through 3 illustrate views of an embodiment of protective member 100. In one embodiment, protective member 100 may be configured for use with a graphic transfer assembly. An example of various types of graphic transfer assemblies are described in the Hull case. More generally, the term "graphic transfer assembly" as used throughout this detailed description and in the claims refers to any collection of components which may be used to transfer a graphic to an object.

For clarity, the following detailed description discusses an exemplary embodiment of a protective member that can be used with articles of footwear, but it should be noted that the protective member may be configured for use with any other kinds of articles. In some embodiments, the protective member may be configured for use with articles that can be worn, including, but not limited to: footwear, gloves, shirts, pants, socks, scarves, hats, jackets, as well as other articles. In other embodiments, the protective member may be configured for use with protective equipment, including, but not limited to: shin guards, knee pads, elbow pads, shoulder pads, as well as any other type of protective equipment. Additionally, in some embodiments, the protective member could be configured for use with non-wearable articles, including, but not limited to: balls, bags, purses, backpacks, as well as other articles that may not be worn.

Referring to FIGS. 1 through 3, for purposes of reference, protective member 100 may be divided into various portions including forward portion 10, middle portion 12 and rearward portion 14. In some cases, forward portion 10 may be associated with a forefoot of an article of footwear. Also, in some cases, middle portion 12 may be associated with a midfoot of an article of footwear. In some cases, rearward portion 14 may be associated with a heel portion of an article of footwear.

It will be understood that forward portion 10, middle portion 12 and rearward portion 14 are only intended for purposes of description and are not intended to demarcate precise regions of protective member 100. In addition, forward portion 10, middle portion 12 and rearward portion 14, can also be applied to individual components of a protective member.

For consistency and convenience, directional adjectives are employed throughout this detailed description corresponding to the illustrated embodiments. The term "longitudinal" as used throughout this detailed description and in the claims refers to a direction extending a length of a protective member. In some cases, the longitudinal direction may extend from a forward portion to a rearward portion of a protective member. Also, the term "lateral" as used throughout this detailed description and in the claims refers to a direction extending a width of a protective member.

In addition, the terms proximal and distal may also be used throughout this detailed description. The term "proximal" as used throughout this detailed description and in the claims refers to a direction generally closer to an article of footwear when the protective member is positioned over a portion of the article of footwear. The term "distal" as used throughout this detailed description and in the claims refers to a direction generally further from an article of footwear when the protective member is positioned over a portion of the article of footwear.

In some embodiments, protective member 100 may include first side portion 110 and second side portion 120. First side portion 110 and second side portion 120 may generally extend along a length of protective member 100. In some cases, protective member 100 can also include proximal portion 130 and distal portion 140. In some cases, proximal portion 130 may be closer to an article of footwear than distal portion 140 when protective member 100 is associated with the article of footwear.

As seen in FIG. 3, in some cases, first side portion 110 and second side portion 120 may be separated, or spaced apart, at proximal portion 130. For example, first peripheral edge 112 of first side portion 110 and second peripheral edge 122 of second side portion 120 may comprise a periphery for opening 150. In some cases, opening 150 may provide access to interior cavity 160.

In some embodiments, first side portion 110 and second side portion 120 may be disposed adjacent to one another at distal portion 140. In some cases, for example, first side portion 110 and second side portion 120 may be joined along distal edge 170. In some cases, distal edge 170 may extend from forward portion 10 to rearward portion 14 of protective member 100. In some cases, distal edge may extend over a substantial majority of the length of protective member 100.

In some embodiments, proximal portion 130 is shaped to receive a portion of an article of footwear. In some cases, proximal portion 130 has the shape of a sole structure in order to fit over the sole of an article of footwear. In other embodiments, however, proximal portion 130 could have any other shape. In other words, proximal portion 130 may not have the shape of a sole structure in all embodiments.

A protective member can include provisions for enhancing the seal between deformable membranes of a graphic transfer assembly. In some cases, one or more portions of a protective member may be contoured. In some cases, one or more side portions of a protective member can provide a highly contoured distal portion.

In different embodiments, the shape of distal portion 140 could vary. In some embodiments, distal portion 140 has a contoured, or curved, shape. In some cases, the curvature of distal portion 140 can be approximately constant. In other embodiments, however, the curvature of distal portion 140 could vary. In some cases, distal portion comprises a convex portion with non-constant curvature. In one embodiment, for example, distal portion could have the approximate shape of a prolate spheroid. In some cases, a contoured shape for distal portion 140, without any substantially flat surfaces, may help enhance the fit of a deformable membrane around an article of footwear.

In some embodiments, a protective member can include provisions for improving manufacturing efficiency. In some cases, for example, a protective member can include provisions that improve the speed at which a user can apply and/or remove a protective member from an article on a graphic transfer assembly. In one embodiment, a protective member can include a handle.

As seen in FIGS. 1 and 2, protective member 100 may include handle portion 175. Handle portion 175 generally comprises a contoured handle including first recessed portion 176 and second recessed portion 178. Handle portion 175 may enhance the ability of a user to quickly grasp distal portion 140 of protective member 100.

Although handle portion 175 is illustrated in FIGS. 1 and 2 as having a generally elongated shape, in other embodiments handle portion 175 could have any other shape. In some cases, handle portion 175 could include one or more holes to help enhance the grip of a user. In still other cases, handle portion 175 could be provided with other features to enhance grip, including, for example, gripping pads.

Figure 4:
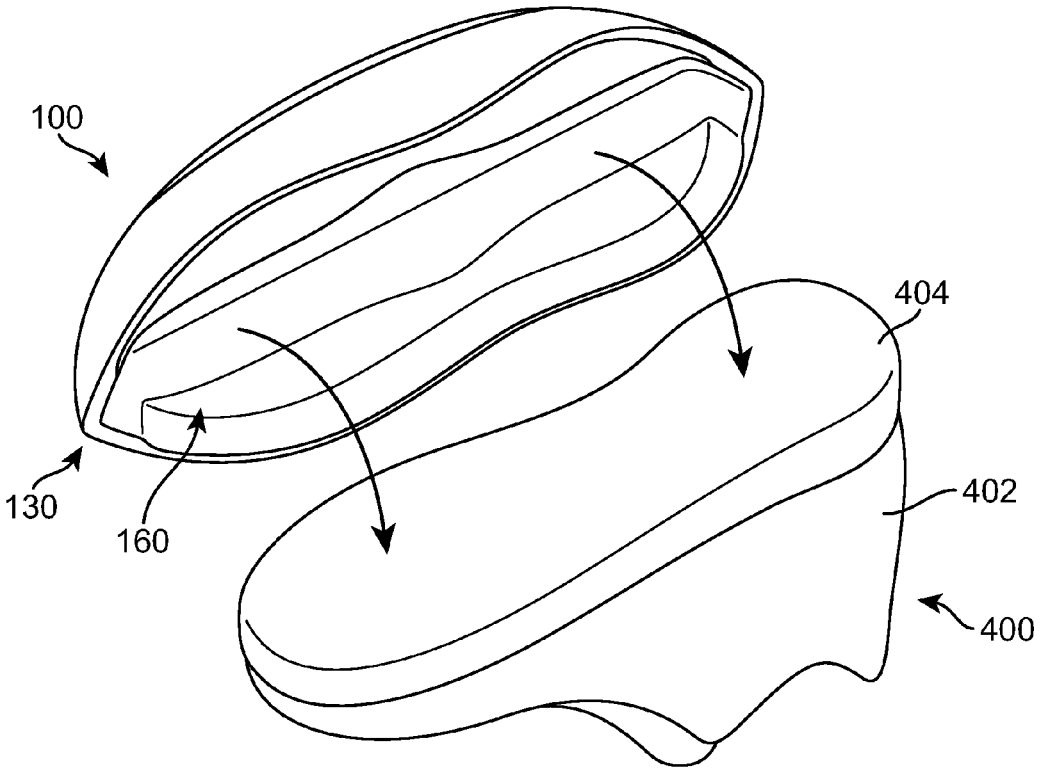
FIG. 4 is an isometric view of an embodiment of a protective member being associated with an article of footwear.
Figure 5:
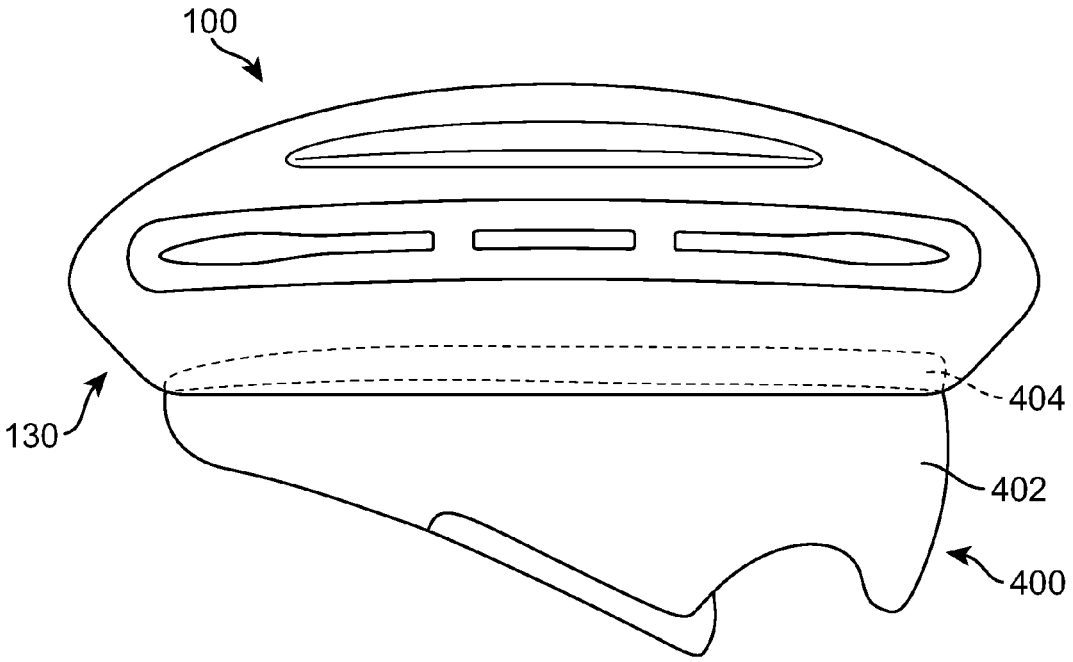
FIG. 5 is a schematic side view of an embodiment of a protective member disposed over a sole structure.

FIGS. 4 through 8 illustrate schematic views of protective member 100 being used to protect a portion of an article during a graphic transfer process. Referring to FIGS. 4 and 5, protective member 100 may be associated with article of footwear 400. Article of footwear 400 may include upper 402 and sole structure 404. The term "sole structure" as used throughout this detailed description and in the claims refers to any portion of a sole, including, but not limited to: an outsole, a midsole or an insole, as well as any combination of these components.

Proximal portion 130 of protective member 100 may be placed over footwear sole structure 404. In some cases, interior cavity 160 may be deep enough to receive footwear sole structure 404. This allows a substantial entirety of footwear sole structure 404 to be covered by protective member 100. Moreover, upper 402 may remain exposed so that a graphic may be applied to one or more portions of upper 402. As described above, in other embodiments where protective member 100 is configured for use with other kinds of articles, proximal portion 130 may be configured to receive any other portion of an article.

Figure 6:
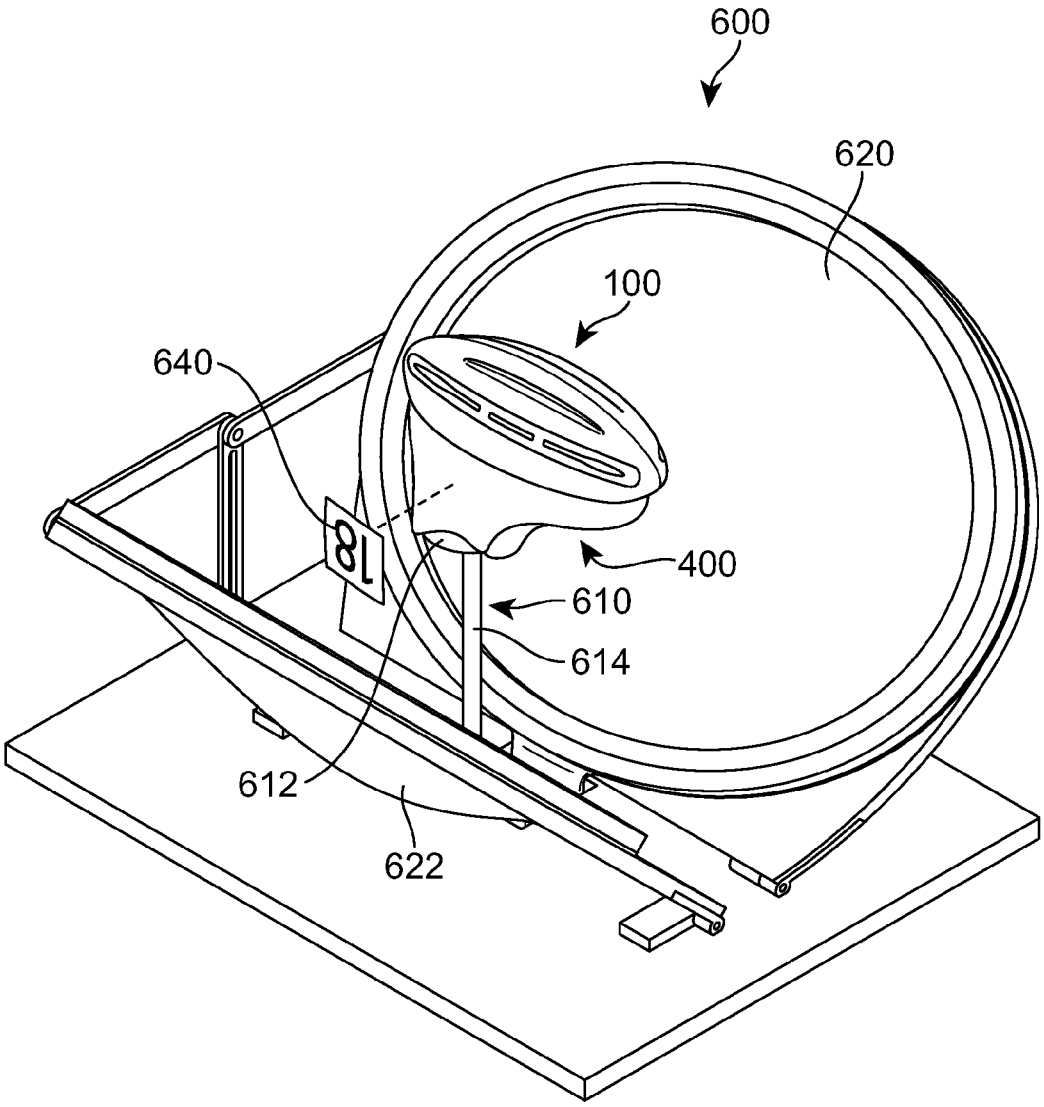
FIG. 6 is a schematic view of a protective member applied to an article of footwear for use with a graphic transfer assembly.
Figure 7:
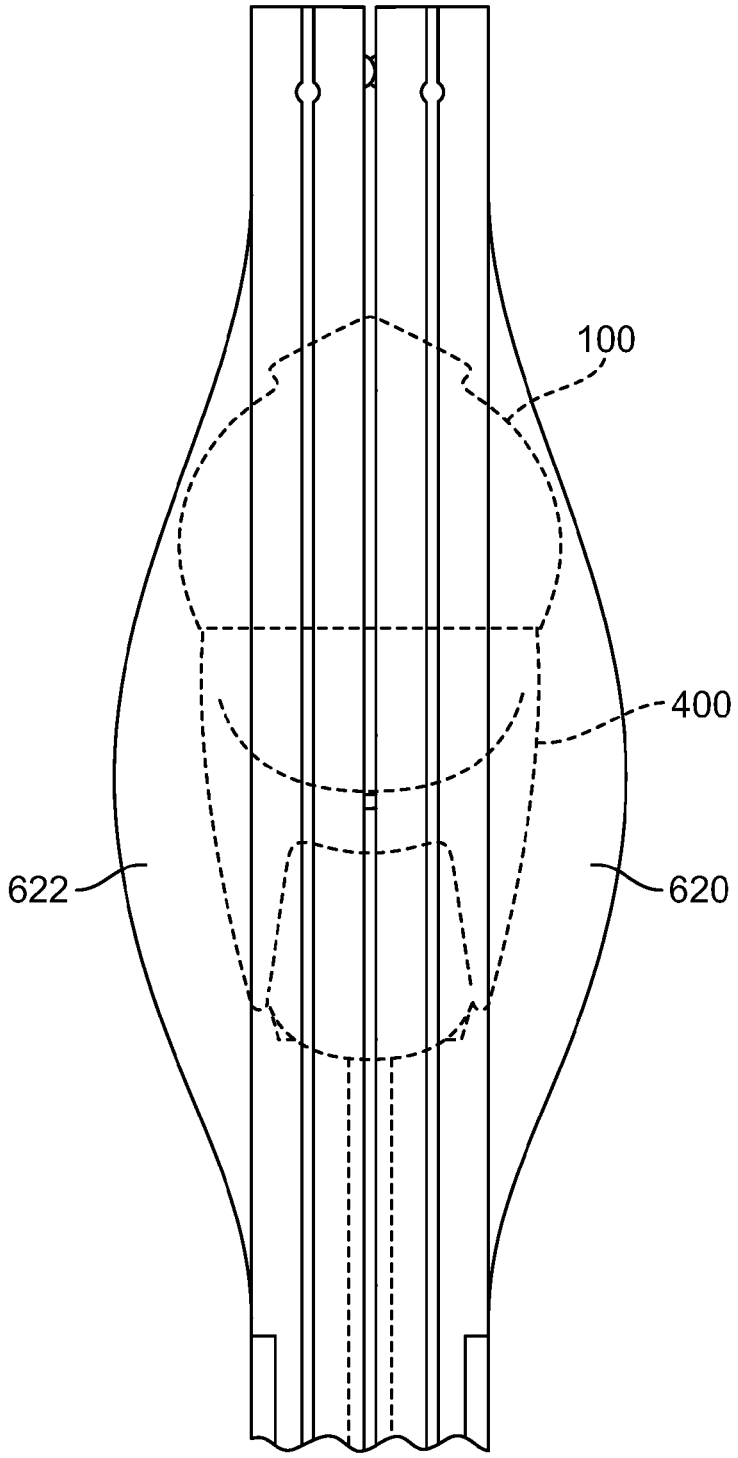
FIG. 7 is a front view of an embodiment of a portion of a graphic transfer assembly with an article of footwear and a protective member disposed between deformable membranes of the graphic transfer assembly.
Figure 8:
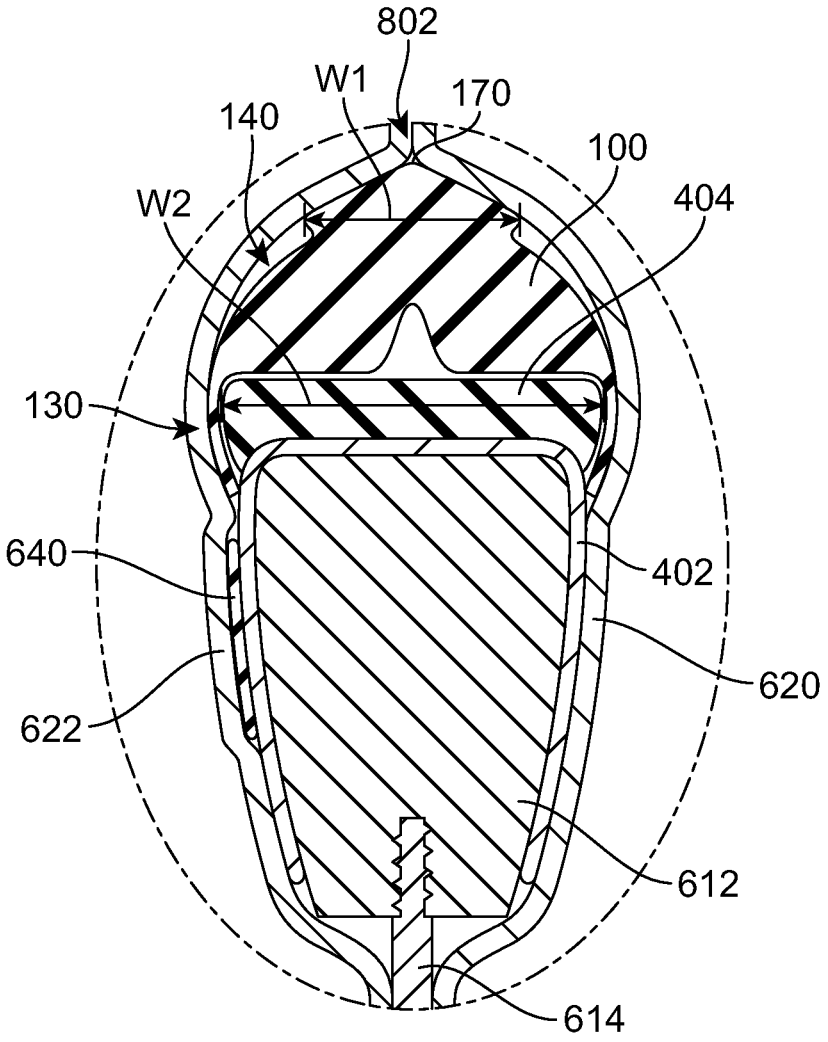
FIG. 8 is a schematic cross sectional view of a protective member and an article of footwear disposed between deformable membranes.

Referring now to FIGS. 6 through 8, article of footwear 400 and protective member 100 may be placed within graphic transfer assembly 600. In some cases, graphic transfer assembly 600 comprises first deformable membrane 620 and second deformable membrane 622 that are assembled in a clamshell-like configuration. In particular, first deformable membrane 620 and second deformable membrane 622 may open and close in a clamshell-like manner around article of footwear 400 and protective member 100. Additionally, in some cases, graphic transfer assembly 600 includes last assembly 610, including last member 612 and post 614.

In order to apply graphic 640 to article of footwear 400, article of footwear 400 may be placed onto last assembly 610. Following this step, first deformable membrane 620 and second deformable membrane 622 may be closed around article of footwear 400 and protective member 100, as seen in FIG. 7. In some cases, a vacuum could be used to ensure that first deformable membrane 620 and second deformable membrane 622 conform to the contours of article of footwear 400. A method of applying a vacuum between deformable membranes is disclosed in the Hull case.

In some embodiments, the shape of protective member 100 is configured to facilitate a better fit between first deformable membrane 620, second deformable membrane 622 and protective member 100. As seen in FIG. 8, a cross sectional view of the embodiment shown in FIG. 7, the contoured shape of distal portion 140 provides for a substantial narrowing of protective member 100 between proximal portion 130 and distal edge 170. For purposes of describing the shape of protective member 100, distal portion 140 may be associated with width W1. Also, proximal portion 130 may be associated with width W2. In some cases, width W1 may be substantially less than width W2. In other words, protective member 100 may taper in width from proximal portion 130 to distal portion 140. With this arrangement, first deformable membrane 620 and second deformable membrane 622 may wrap more tightly against protective member 100.

The contoured surface of distal portion 140 may allow for a more natural meet 802 between first deformable membrane 620 and second deformable membrane 622 at a location just above distal edge 170. This arrangement may facilitate a better seal between first deformable membrane 620 and second deformable membrane 622. Moreover, improving the seal between first deformable membrane 620 and second deformable membrane 622 may enhance the effectiveness of the graphic transfer process.

Protective member 100 can also provide protection for components of a graphic transfer assembly. For example, in some cases an article of footwear may include cleats. In situations where a deformable membrane of a graphic transfer assembly is substantially thin, cleats from a sole could potentially tear, rip or otherwise damage the membrane. Using a substantially rigid protective member that covers a sole, including cleats, may help maintain the structural integrity of the graphic transfer assembly.

Figure 9:
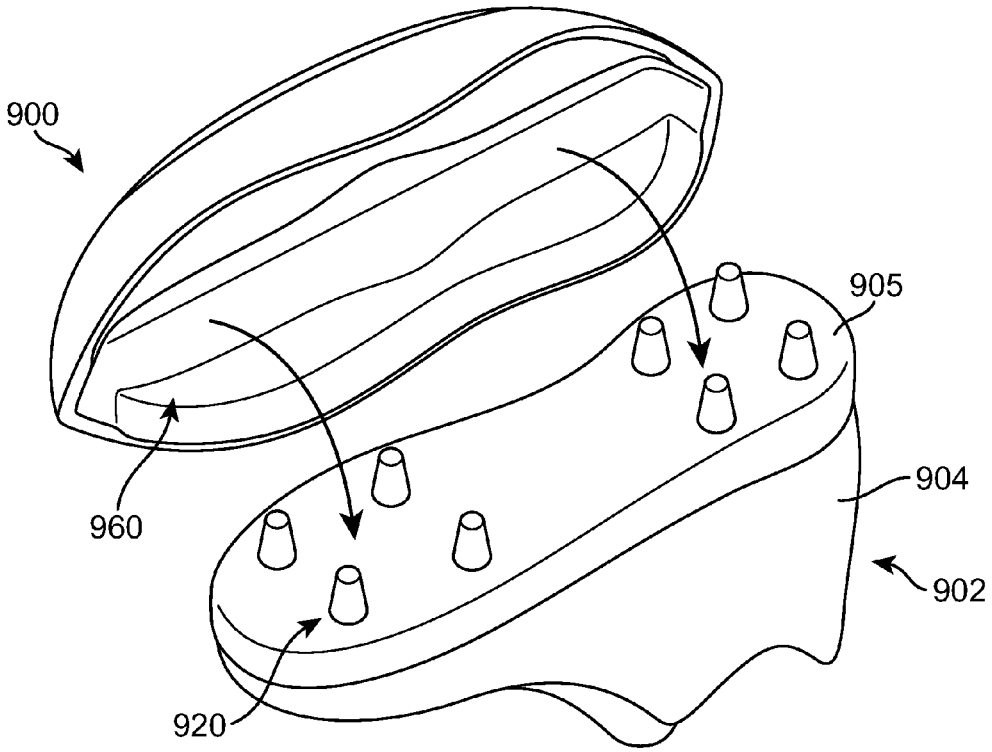
FIG. 9 is a schematic isometric view of a protective member being associated with an article of footwear including cleats.
Figure 10:
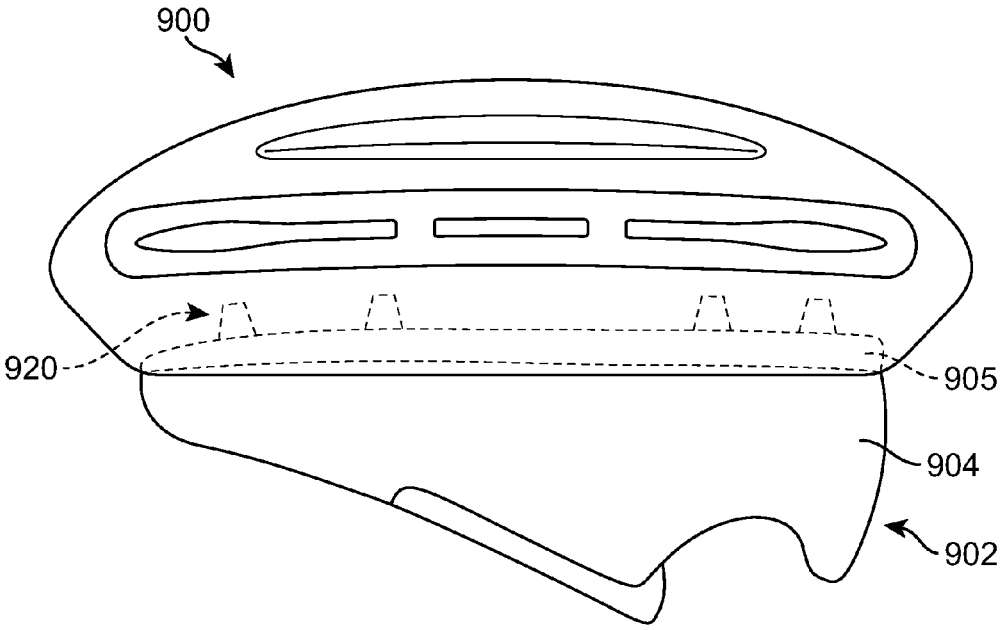
FIG. 10 is a schematic side view of an embodiment of a protective member covering a sole structure with cleats.

FIGS. 9 and 10 illustrate schematic views of an embodiment of a protective member 900 that is configured to cover a sole structure with cleats. Referring to FIGS. 9 and 10, article of footwear 902 includes footwear upper 904 and sole structure 905. Sole structure 905 may further include plurality of cleats 920. In this case, interior cavity 960 of protective member 900 may be sized to receive footwear sole member 905 as well as plurality of cleats 920.

Figure 11:
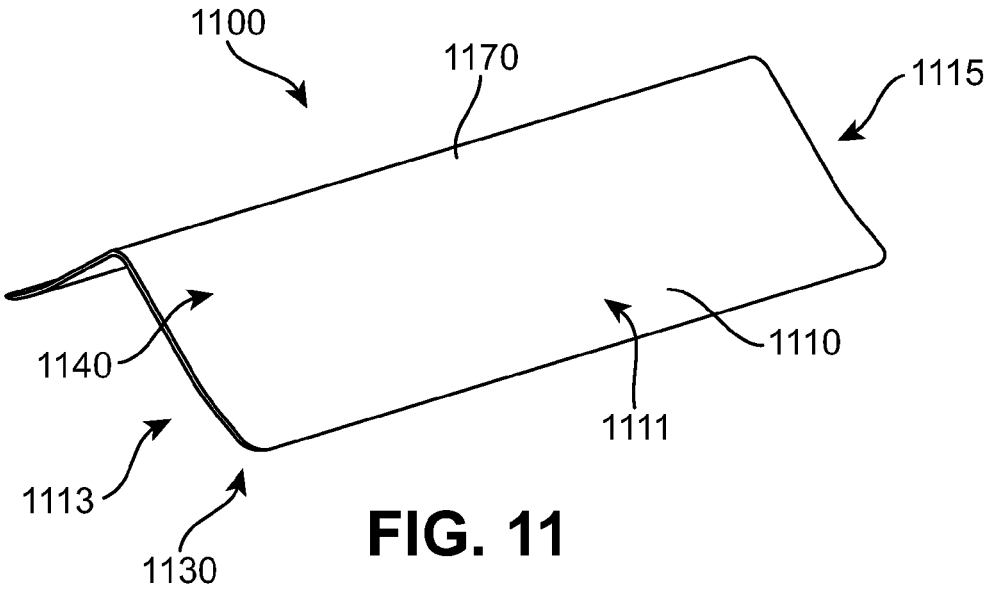
FIG. 11 is an isometric view of another embodiment of a protective member.
Figure 12:
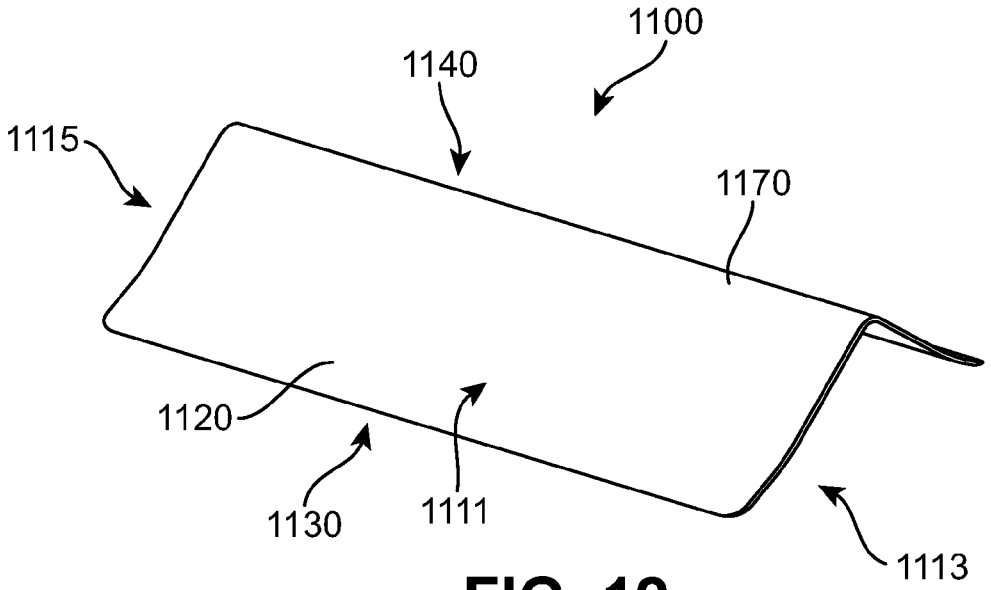
FIG. 12 is an alternative isometric view of the protective member shown in FIG. 11.
Figure 13:
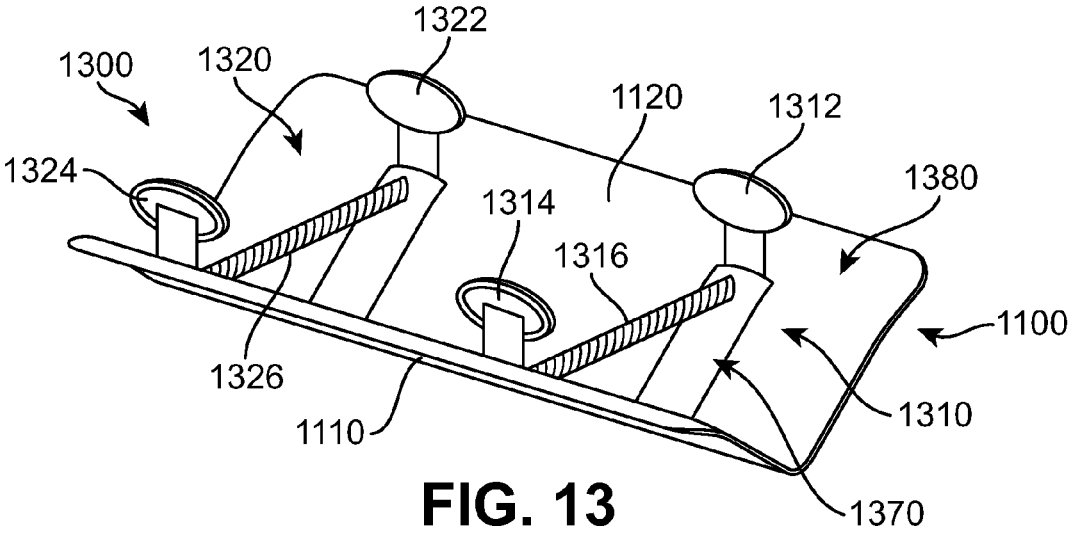
FIG. 13 is a schematic view of a proximal portion of a protective member including a clamp system.

FIGS. 11 through 13 illustrate another embodiment of a protective member 1100 that may be used with a graphic transfer assembly. In some embodiments, protective member 1100 may include first side portion 1110 and second side portion 1120. First side portion 1110 and second side portion 1120 may generally extend along a length of protective member 1100. In some cases, protective member 100 can also include proximal portion 1130 and distal portion 1140. In some cases, proximal portion 1130 may be closer to an article of footwear than distal portion 1140 when protective member 100 is associated with the article of footwear.

In some embodiments, protective member 1100 comprises a substantially flexible material that is configured to wrap around a sole structure and/or footwear upper portion of an article. In one embodiment, for example, protective member 1100 could comprise a single layer of material that is folded along distal edge 1170. In other cases, however, first side portion 1110 and second side portion 1120 may be distinct portions of material that are joined along distal edge 1170.

Figure 14:
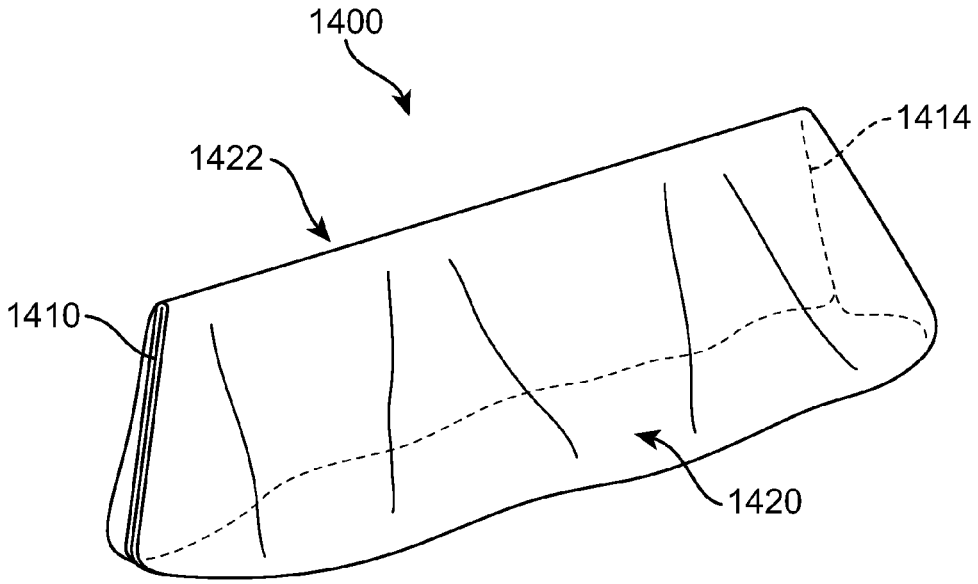
FIG. 14 is a schematic isometric view of another embodiment of a protective member.

The current embodiment illustrates side portions that may be substantially flat. However, other embodiments can incorporate side portions that include additional contouring. In some cases, for example, central portions 1111 of first portion 1110 and second side portion 1120 may bow outwardly. Moreover, in some cases, forward edges 1113 and/or rearward edges 1115 of first side portion 1110 and second side portion 1120 may be attached and/or integrally formed with one another. As an example, an alternative example of a protective member 1400 is shown in FIG. 14. Protective member 1400 includes first side portion 1420 and second side portion 1422 that are joined together at forward portion 1410 and rearward portion 1414. In still other cases, the side portions of a protective member could be joined at a forward portion and separated at a rearward portion. In still other cases, the side portions of a protective member could be joined at a rearward portion and separated at a forward portion.

Referring now to FIGS. 13 through 16, protective member 1100 can include provisions for attaching to an article of footwear in order to provide protection for a sole structure. Generally, any kinds of fastening devices or systems can be used. Examples of fastening systems that could be used to keep protective member 1100 fixed in place with respect to an article of footwear include, but are not limited to: clamping systems, snapping systems, screw-type systems, zipper systems, button systems, lacing systems as well as any other kinds of fastening systems known in the art. In one embodiment, protective member 1100 may include clamping system 1300.

Figure 15:
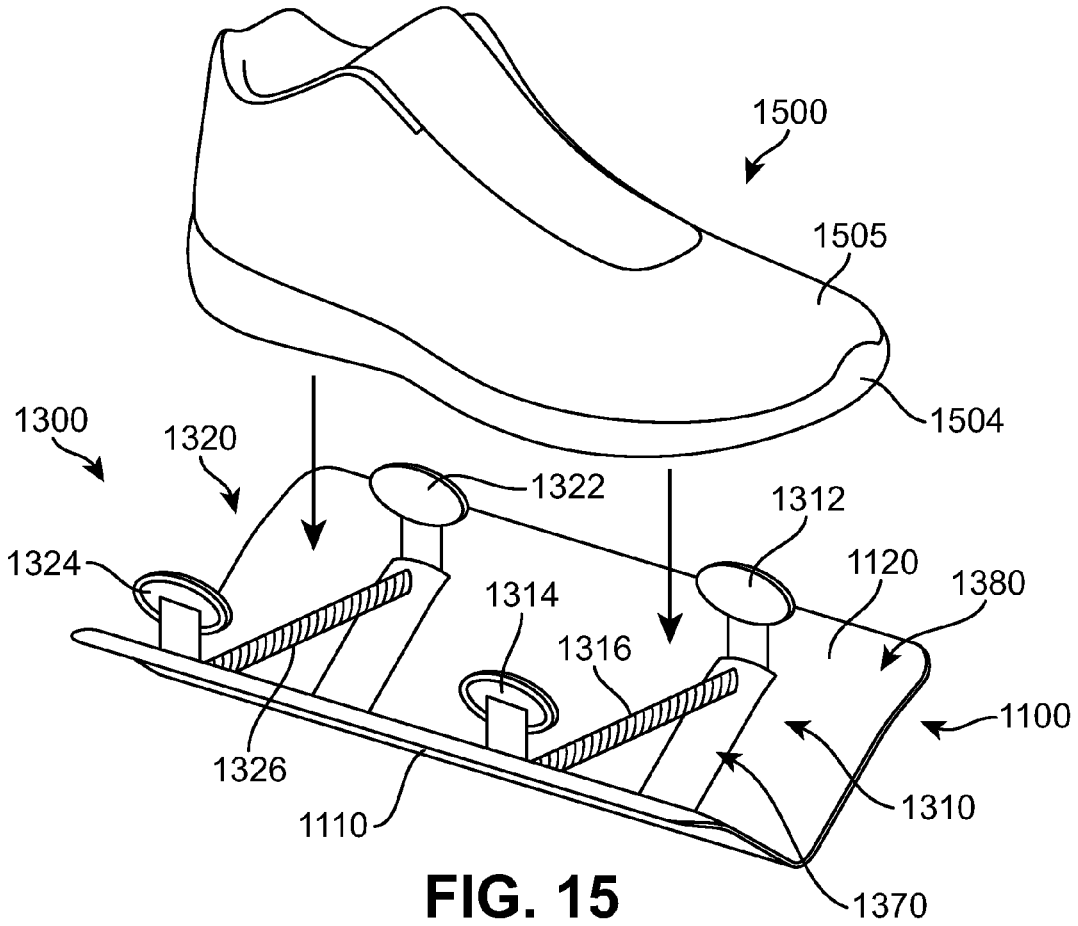
FIG. 15 is a schematic isometric view of an embodiment of an article of footwear being associated with a clamp system of a protective member.
Figure 16:
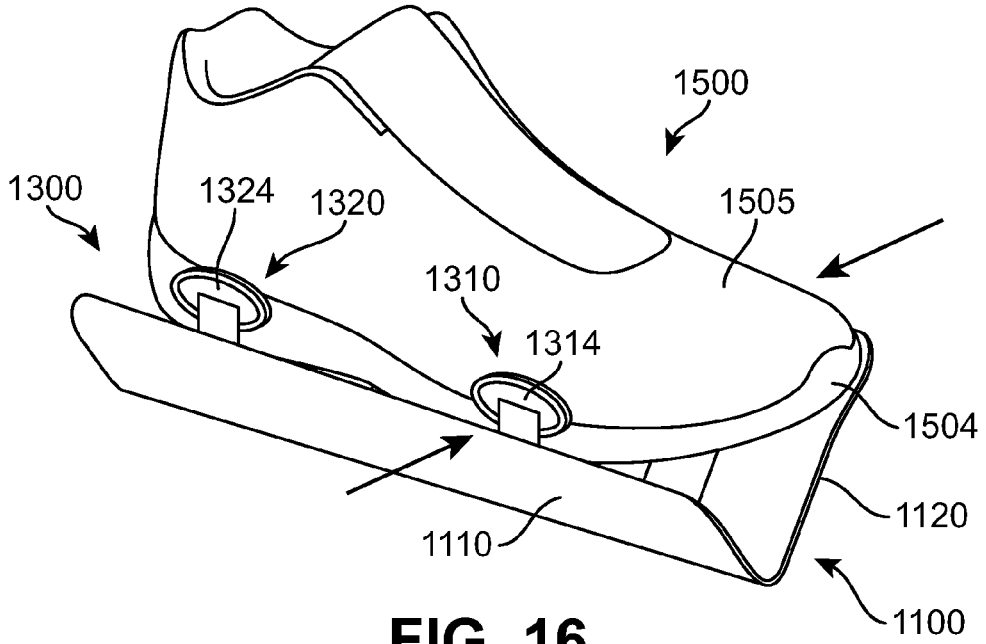
FIG. 16 is a schematic isometric view of an embodiment of a protective member attached to an article of footwear using a clamp system.

Clamping system 1300 can include first clamping device 1310 and second clamping device 1320. First clamping device 1310 may include first clamping portion 1312 and second clamping portion 1314. In some cases, first clamping portion 1312 and second clamping portion 1314 may be joined together by first spring member 1316. Likewise, second clamping device 1320 may include third clamping portion 1322 and fourth clamping portion 1324. In some cases, third clamping portion 1322 and fourth clamping portion 1324 may be joined together by second spring member 1318. As seen in FIGS. 15 and 16, this arrangement provides a method of clamping protective member 1100 to sole structure 1504 of article of footwear 1500. In some cases, one or more clamping portions could also be applied to portions of upper 1505 of article of footwear 1500.

Components of clamping system 1300 may be secured to inner surface 1380 of protective member 1100 using any know methods. Examples of securing methods include, but are not limited to: adhesives, staples, stitching, screws, nails as well as any other methods. In some cases, inner surface 1380 may include sleeves 1370 which may receive portions of first clamping device 1310 and second clamping device 1320.

Still other embodiments could include different numbers, sizes and/or types of clamping devices. For example, another embodiment could include three clamping devices for gripping a sole structure. Still another embodiment could include screw-type clamping devices rather than using springs. Still other embodiments could include larger clamping portions at a rearward portion and smaller clamping portions at a forward portion. Such an embodiment could accommodate sole structures having larger heel portions than forefoot portions.

Figure 17:
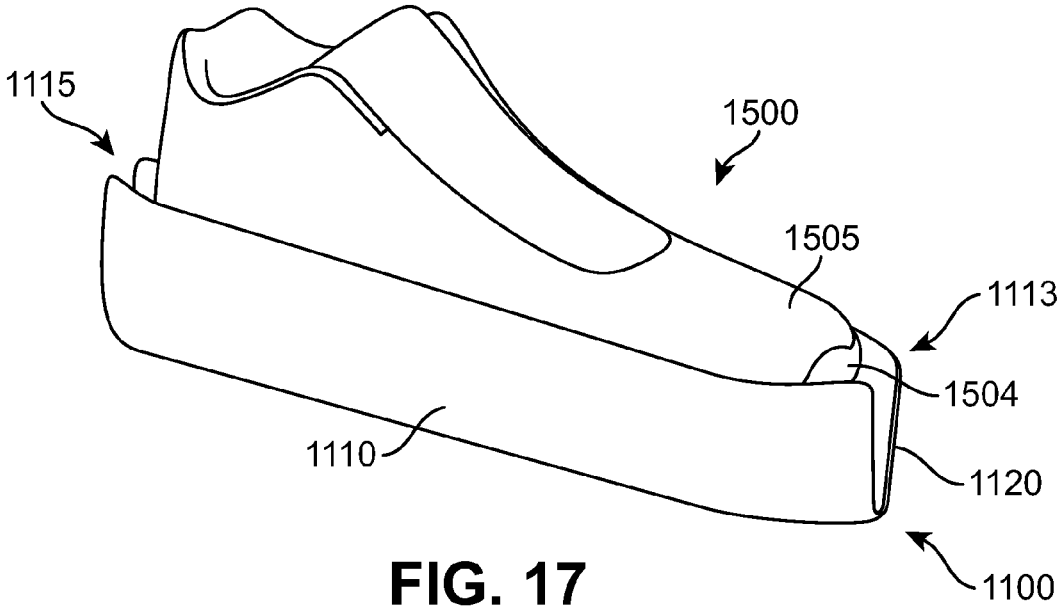
FIG. 17 is a schematic isometric view of an embodiment of a protective member covering a sole structure.

FIG. 17 illustrates an embodiment of protective member 1100 in a position to cover a majority of sole portion 1504. In particular, first side portion 1110 and second side portion 1120 are positioned to cover the sides of sole portion 1504. Moreover, forward edges 1113 and rearward edges 1115 extend forwardly and rearwardly from the front and back of article of footwear 1500 to provide some additional protection to the front and back portions of sole structure 1504. This arrangement therefore provides a protective barrier around sole structure 1504.

Figure 18:
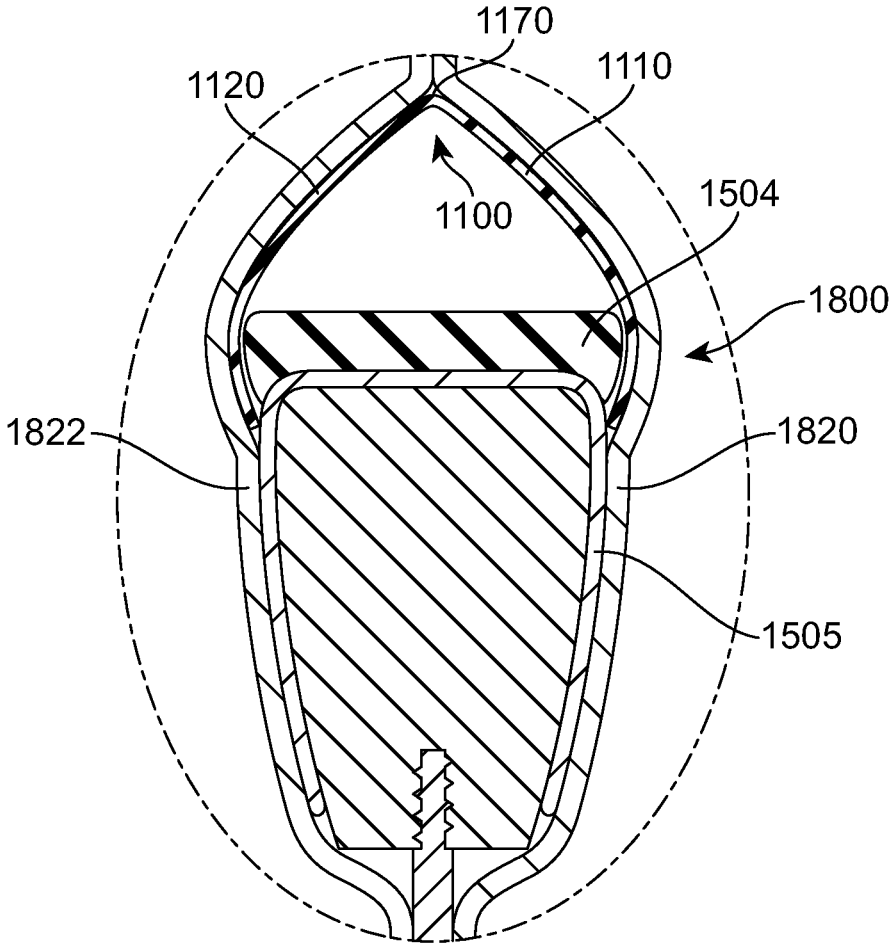
FIG. 18 is a schematic cross sectional view of a protective member and an article of footwear disposed between deformable membranes.

FIG. 18 illustrates a schematic cross sectional view of protective member 1100 covering sole structure 1504. In this situation, protective member 1100 and article of footwear 1500 are disposed between first deformable membrane 1820 and second deformable membrane 1822, which are components of graphic transfer assembly 1800. In some cases, first side portion 1110 and second side portion 1120 may be sloped towards distal edge 1170. In some cases, the cross-sectional shape of distal portion 1140 may be approximately triangular near distal edge 1170. As discussed with respect to a previous embodiment, this arrangement may facilitate a better seal between first deformable membrane 1820 and second deformable membrane 1822.

With this arrangement, protective member 1100 may provide heat protection for sole structure 1504. Additionally, in some cases, protective member 1100 could also help prevent portions of sole structure 1504 from damaging first deformable membrane 1820 and/or second deformable membrane 1822.

In different embodiments, the materials comprising of protective member 100 may vary. In some embodiments, materials for protective member 100 can be selected to achieve a desired degree of rigidity, density, weight and/or durability. In some cases, materials having low thermal conductivity could be selected. Using materials with low thermal conductivities may help protect a sole structure from heat applied during a graphic transfer process. Examples of different materials that could be used for protective member 100 include, but are not limited to: polymers, plastics, low density foam, high density foam, composite materials, as well as any other materials. In other embodiments, a protective member can be made of multiple different materials and different portions of the protective member could be provided with different material properties.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A protective member for an article of footwear, comprising:

a forward portion, a rearward portion, and a middle portion between the forward portion and the rearward portion;

a first side portion and a second side portion extending along a length of the protective member;

a proximal side where the first side portion and the second side portion are separated and form an opening shaped to conform to an outer peripheral surface of a sole structure of the article of footwear, the first side portion and the second side portion extending inwardly toward each other to narrow the opening along the middle portion of the protective member at the proximal side;

wherein the opening is widest at the forward portion between the middle portion and a forward most end of the protective member and is narrower at the middle portion than at either of the forward portion or the rearward portion;

a distal side at which the first side portion and the second side portion are joined and are contoured to form a handle, the handle extending between the forward portion and the rearward portion;

the protective member having a contoured cross-sectional shape that generally tapers from the proximal side to the distal side; and wherein the first side portion and the second side portion comprise a rigid material.

2. The protective member according to claim 1, wherein the protective member comprises a material having a low thermal conductivity.

3. The protective member according to claim 1, wherein the first side portion and the second side portion are substantially convex between the distal side and the proximal side.

4. The protective member according to claim 1, wherein the shape of the protective member may be approximately similar to a prolate spheroid.

5. The protective member according to claim 1, wherein the distal side has an approximately triangular shape along a portion of the handle.

6. The protective member according to claim 1, wherein the protective member provides a barrier between the sole structure and at least one deformable membrane of a graphic transfer assembly and wherein the shape of the distal side is configured with a constant curvature to enhance the seal between a first deformable membrane of the graphic transfer assembly and a second deformable membrane of the graphic transfer assembly.

7. The protective member according to claim 1, wherein the proximal side is configured to receive cleats.

8. The protective member according to claim 1, wherein the protective member is monolithic across a width at the distal side.

9. The protective member according to claim 1, wherein the distal side comprises two recessed portions adjacent the handle on opposite sides of the protective member.

10. A shoe sole protective member comprising:

a first side wall comprising a distal edge and a proximal edge;

a second side wall comprising a distal edge and a proximal edge;

the first side wall and the second side wall extending along a length of the shoe sole protective member, and being spaced apart along the proximal edges and forming an opening between the proximal edges, the opening conforming to a shoe sole structure comprising a forefoot, a midfoot, a heel, and a bottom;

a forefoot region corresponding to the forefoot of the shoe sole structure;

a midfoot region corresponding to the midfoot of the shoe sole structure;

a heel region corresponding to the heel of the shoe sole structure; and a handle adjacent the distal edges of the first and second side walls and extending along an outer surface of the shoe sole protective member between the forefoot region and the heel region;

the first and second side walls defining an interior cavity including a substantially flat interior surface shaped to conform to the bottom of the sole structure, the interior surface positioned within the interior cavity a distance from the proximal edges of the first and second side walls and extending a length of the interior cavity between the forefoot region and the heel region;

wherein the opening includes a first width at the forefoot region, a second width at the midfoot region, and a third width at the heel region, and wherein the opening is narrower at the second width than at either the first width or the third width, and the opening is widest at the first width; and wherein the first side wall and the second side wall each comprise a rigid material of low thermal conductivity.

11. The shoe sole protective member according to claim 10, wherein the interior surface is positioned within the interior cavity a distance from the proximal edges of the first and second side walls that is approximately equal to a thickness of the shoe sole structure.

12. The shoe sole protective member according to claim 10, wherein the distance at which the interior surface is positioned within the interior cavity from the proximal edges is substantially constant along the length of the interior cavity between the forefoot region and the heel region.

13. The shoe sole protective member according to claim 10, wherein the first and second side walls each include a recess adjacent the handle.

14. The shoe sole protective member according to claim 10, wherein the first and second side walls taper generally outwardly away from the handle.

15. The shoe sole protective member according to claim 10, wherein the first and second side walls do not include any openings into the interior cavity between the distal and proximal edges.

* * * * *